United States Patent [19]

Alonso

[11] 3,977,501

[45] Aug. 31, 1976

[54] LUGGAGE CASE CONSTRUCTION

[75] Inventor: Juan Perez Alonso, Naucalpan de Juarez, Mexico

[73] Assignee: Samsonite Corporation, Denver, Colo.

[22] Filed: June 24, 1974

[21] Appl. No.: 482,274

[30] Foreign Application Priority Data

Mar. 25, 1974 Mexico ..... 150089

[52] U.S. Cl. ..... 190/49; 190/54

[51] Int. Cl.[2] ..... A45C 3/00; A45C 13/00

[58] Field of Search ..... 190/23, 24, 25, 40, 190/41 R, 41 C, 43, 49, 53, 54, 37

[56] References Cited

UNITED STATES PATENTS

| | | | |
|---|---|---|---|
| 3,298,480 | 1/1967 | Kish | 190/54 |
| 3,305,052 | 2/1967 | Kish | 190/49 |
| 3,411,610 | 11/1968 | Bialo | 190/49 |
| 3,477,553 | 11/1969 | Kish | 190/49 |
| 3,497,041 | 2/1970 | Samhammer | 190/49 |
| 3,592,314 | 7/1971 | Jacobson | 190/49 |

*Primary Examiner*—William Price
*Assistant Examiner*—Steven M. Pollard
*Attorney, Agent, or Firm*—George J. Netter

[57] ABSTRACT

The luggage case construction has a first open sided shell over which a cover is removably secured. The shell includes bottom, top and two end walls interconnected by a rectangular back wall. An elongated frame member extends continuously along the inner top wall surface, both end walls and for a distance inwardly of the end walls onto the bottom wall. The frame is centrally located within the shell and includes a pair of parallel rib-like elements integrally related by a wall portion via which it is riveted to the luggage case shell. At each of the corners of the luggage case sheel and in the central portion immediately under the handle of the top wall there are provided sheet-like elements between the channel and the luggage case walls. The sheet-like members extend transversely of the luggage case an amount equal to the total case width, such that when the cover is closed over the shell and the secured in place, the sheet-like member establishes a firm case width.

7 Claims, 5 Drawing Figures

FIG. 3.
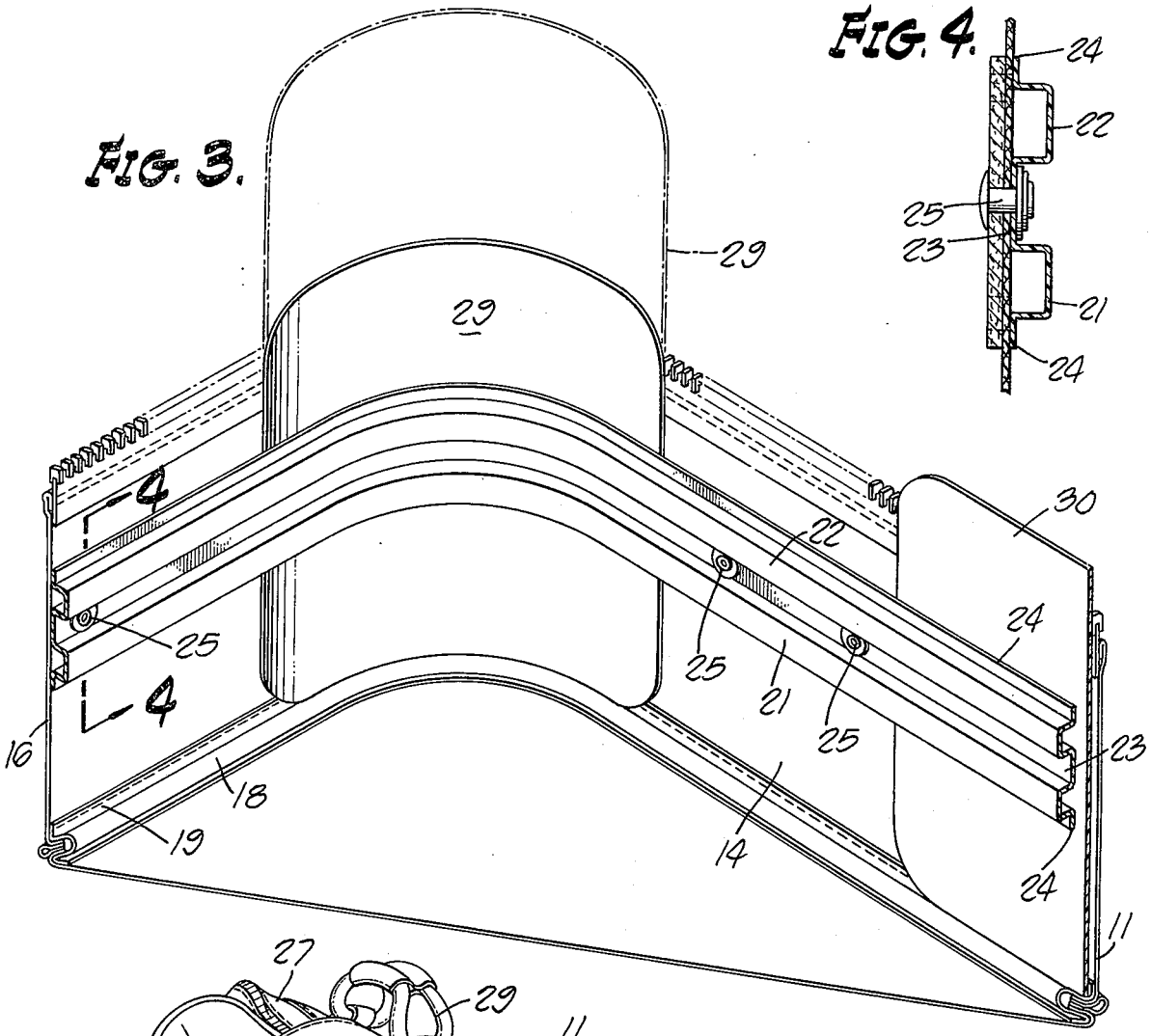
FIG. 4.
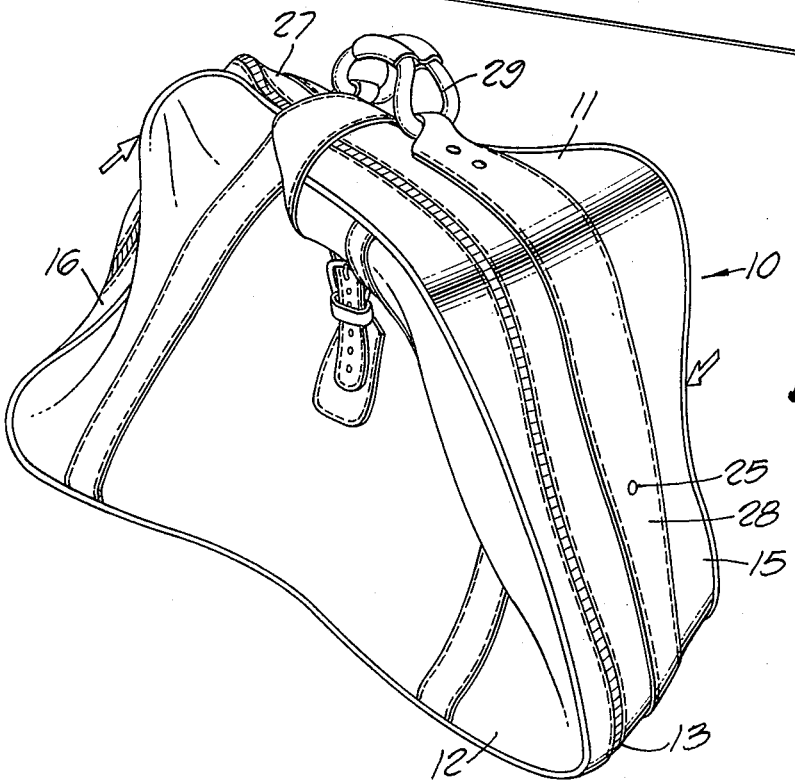
FIG. 5.

LUGGAGE CASE CONSTRUCTION

The present invention relates generally to a luggage case construction, and, more particularly, to a reinforcing frame for so-called soft sided luggage which enables the luggage case to experience substantial deformation and return to its original configuration.

BACKGROUND OF THE INVENTION

Soft sided luggage typically includes outer walls or panels constructed of leather, plastic, fabric, or other sheetlike materials which are pliant, readily conform to externally applied pressures and are somewhat soft to the touch. Such luggage requires a frame or other means for rigidifying the structure sufficiently to maintain an overall case-like appearance and to withstand the normal handling to which it is subjected. In the past, metallic stiffening members have been used, which, although providing the requisite strength, are unsatisfactory in several other respects. First of all, such metal members or frames, if subjected to a considerable external force, such as, for example, if other luggage were thrown or dropped onto the case, would be permanently deformed. In still other situations, where the metallic frame members were spring-like quality, the deformation could take place to a limited degree and still return to the original shape; however, if a considerable amount of deformation were experienced by the bag, it would either break the frame or, on exceeding the frame elastic limit, produce permanent deformation. Also, such metal frames are relatively expensive to manufacture and incorporate into the case. Still further, care must be taken to insure that metal frame members do not have burrs or sharp edges or corners which could be a source of injury to a user.

OBJECTS AND SUMMARY OF THE INVENTION

It is, therefore, a primary object and aim in the subject invention to provide a reinforcing frame for a luggage case which can withstand substantial deforming forces and return to its original shape without being damaged.

Another object of the invention is the provision of a supporting frame for cooperative relation with a soft side luggage case to maintain the case dimensional integrity during normal handling and which can withstand torsional and beam stressing without permanent deformation.

In the practice of the present invention, there is provided a soft sided luggage case construction having a first open sided shell over which is removably secured a cover or side member. The shell includes bottom, top and two end walls interconnected by a relatively large rectangular back wall. An elongated channel member extends continuously along the inner top wall surface, both end walls and for a short distance inwardly of the end walls onto the bottom wall. The channel is centrally located within the shell and includes a pair of parallel rib-like elements integrally related by a relatively thin wall portion via which it is riveted to the luggage case shell. At each of the corners of the luggage case shell and in the central portion immediately under the handle of the top wall there are provided sheet-like plastic elements positioned between the channel and the luggage case walls. The sheet-like members extend transversely of the luggage case an amount equal to the total case width, such that when the cover is closed over the shell and secured in place, the sheet-like member establishes a firm case width.

DESCRIPTION OF THE DRAWING

FIG. 3 is an enlarged sectional view of an internal corner of the luggage case of this invention, showing the corner supports and reinforcing or stiffener frame in place.

FIG. 4 is a sectional view taken along the line 4—4 of FIG. 3.

FIG. 5 is a perspective view of the luggage case of this invention showing it being subjected to both torsional and bending forces.

DESCRIPTION OF A PREFERRED EMBODIMENT

Figure 1:
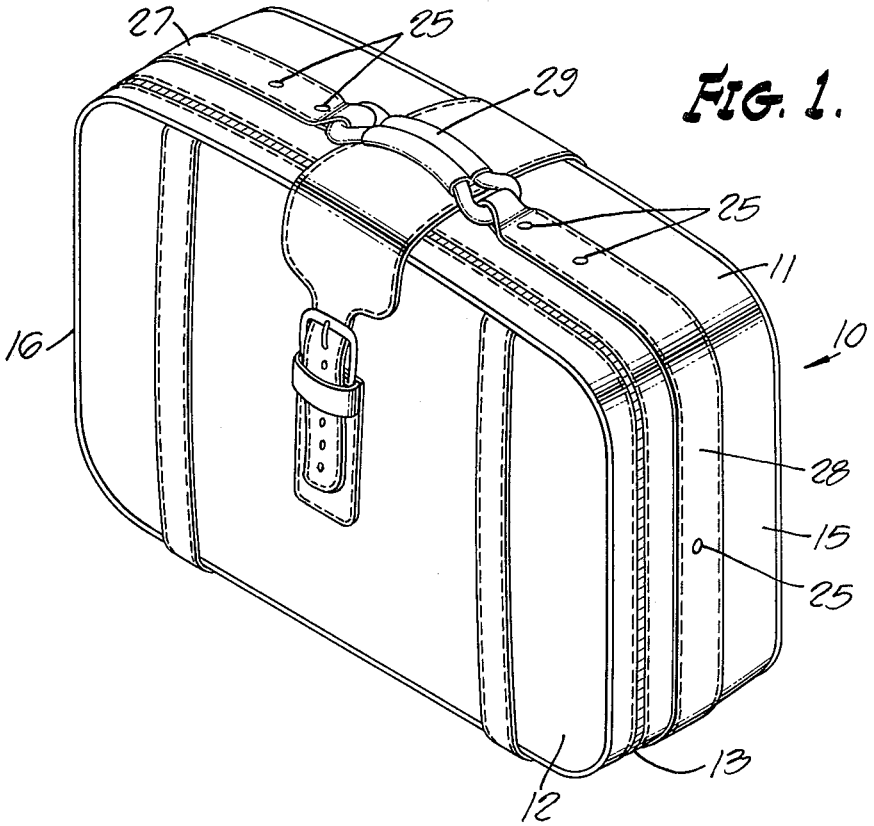
FIG. 1 is a perspective view of a luggage case construction in accordance with the present invention.

Turning now to the drawings and particularly FIG. 1, there is shown a typical soft sided luggage case 10 within which the frame and supporting structure to be described herein derives its primary utility. As shown, the outer side walls of the luggage case 10 are constructed of a material such as leather, fabric, vinyl, or the like, which is pliant and flexible such that the entire case not only has a soft appearance, but readily deforms on being subjected to external pressures. More particularly, the luggage case 10 comprises a pair of mating elements 11 and 12 joined together as at 13 by a zipper, for example. That is, the case element 11, as is more particularly shown in FIG. 3, includes end walls, top and bottom walls and a back wall integrally related to form an open shell which defines the major item containing space of the luggage case. The element 12 is a shallow cover which in assembled condition encloses the open side of the element 11. Although other types of closing means for elements 11 and 12 may be utilized, such as clasps and latches or the like, it is contemplated that in the more usual case a zipper as 13 would be preferred.

With reference now to FIG. 3, the shell 11 is seen to include an elongated strip or sheet of flexible or pliant material, e.g., vinyl, of substantially constant width and thickness, forming the upper or top wall 14 and two end walls 15 and 16, and a part of the bottom wall. The common outwardly facing edge of the members 14 through 16 includes one-half of the zipper 13, whereas the opposite edge is joined to the back wall 17 by a bead 18, via one or more lines of stitching, for example. The head 18, along the line of juncture with the walls 14 through 16, includes a groove 19 continuously extending thereabout for a purpose and use to be described.

Figure 2:
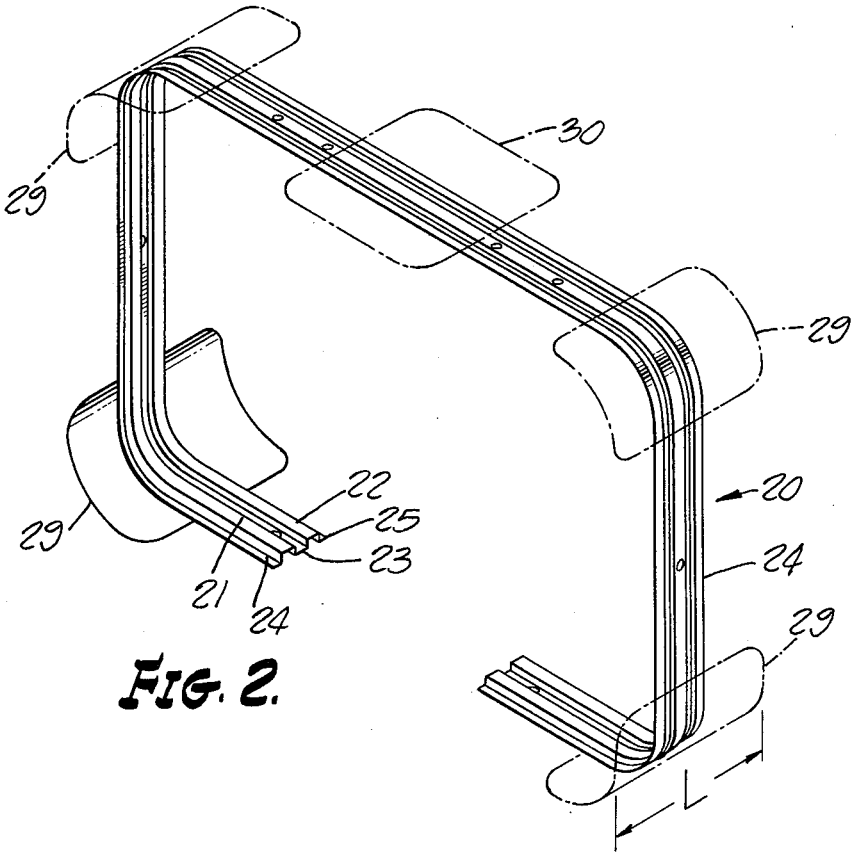
FIG. 2 is a perspective schematic view of the frame construction alone, shown removed from the luggage case of FIG. 1.

Referring now to both FIGS. 2 and 3, an elongated stiffener or reinforcing frame 20 is provided which extends completely around the interior of the top and end walls 14 through 16 as well as extending approximately one-third inwardly onto each end of the bottom wall. This stiffener or reinforcing frame has a pair of continuous parallel raised portions 21 and 22, which are separated by a central recess 23 and further include outer margins or flanges 24 and 25. The outwardly directed surface of flanges 24 and 25 and the surface lying opposite the recess 23 lie in a common plane with the raised portions 21 and 22, extending inwardly therefrom. The stiffener or reinforcing frame is constructed and dimensioned to fittingly engage the top, end and bottom walls in a substantially continuous and intimate contacting relation along the internal case periphery. The corners of the case and those portions of the reinforcing frame conforming to the corners are formed at a substantial radius of length substantially equal to the width of the reinforcing force. A large radius corner as described is capable of withstanding considerably more torsional stresses than a sharp or small-radius corner.

The reinforcing frame is constructed of polyvinylchloride (PVC), which is extruded into the final desired shape. PVC not only has the necessary rigidity for maintaining the luggage case configuration during normal handling and usage, but also in the described form can withstand considerable deforming forces both beam and torsional.

Securement of the frame to the shell 11 is accomplished by rivets 26, for example, one in each end wall, one immediately adjacent each end of the frame in the bottom wall and several in the upper wall. The outer ends of the rivets may be provided with an ornamental surface, such as a chrome plated head, for example.

A pair of bandlike or straplike elements 27 and 28, joined together by a handle 29 are affixed to the outer surface of the shell 11 by one or more lines of stitching, for example. Specifically, each bandlike element is constructed of a pliant sheetlike material, e.g., vinyl, has a width substantially equal to or slightly greater than that of the frame 20, and extends along approximately one-half of the top wall, a portion of the bottom wall and the full height of an end wall 15 or 16, as the case may be. Also, the bandlike element is centered on the frame 20 and the rivets extend therethrough with the rivet heads serving both as ornamentation and as additional securement for the elements 27 and 28. By this construction, carrying forces are transferred from the handle 29 to the straplike elements and via the rivets directly to the frame 20, an exceptionally strong configuration.

In each of the case corner regions there is provided a generally rectangular sheet-like member 29 with radiused corners. The members 29 are located between the reinforcing frame and the luggage case wall as shown in FIGS. 2 and 3, and have a length L equal to the corresponding full interior luggage case dimension. It is to be noted that when fully in place, each of the members 29 are positioned with its inner edge received within the groove 19, which retains the sheet against the outer wall, avoiding the possibilities of obstruction with items received within the case. A further sheet-like member 30, of geometry and dimensions identical to the member 29, is located between the frame 20 and upper wall 14 immediately under the handle 29. This maintains the upper central portion of the luggage in extended condition, and prevents the partial collapsing in that region which could otherwise occur during carrying, for example.

In a practical construction of the invention, the luggage case measured approximately 16 inches × 7 inches × 24 inches. The extruded PVC reinforcing frame 20 has an overall width of approximately 2 inches, the projections 21 and 22 extended upwardly 5/16 of an inch, each of the latter being ½ inch wide, and the frame thickness being approximately 3/32 of an inch. This luggage case was repeatedly subjected to substantial twisting and bending forces, after each of which the frame returned to its original configuration with no impairment or signs of fatigue found. For example, the two ends of the case were twisted in opposite directions to the extent that the upper wall contacted the lower wall as shown in FIG. 5, and on release the case immediately reassumed the shape shown in FIG. 1. Bending forces were applied vertically downwardly onto the case top wall until the top wall central portion was deformed at least halfway to the lower wall, and on release the frame and case walls were unharmed and immediately returned to their original shape.

What is claimed is:

1. A luggage case construction, comprising:

an open-sided shell of relatively soft flexible material and generally rectangular geometry having back, top, bottom and end walls;

a cover removably located over the shell open side; and an elongated flexible stiffener of predetermined configuration having a width dimension at least several times that of its overall thickness arranged to extend along the inner surface of the shell end, top and a portion of the bottom walls and in continuous contact therewith, said stiffener having such flexibility and memory characteristics that it can withstand deforming forces applied to the top wall sufficient to bring the top wall into contact with the bottom wall, and on removal of the deforming forces the stiffener will reassume its predetermined configuration.

2. A luggage case construction as in claim 1, in which said flexible stiffener is affixed to the shell walls via rivets.

3. A luggage case construction as in claim 1, in which there is further provided straplike means arranged about the shell exterior surfaces of the top, side and bottom walls and lying directly opposite the stiffener; and a plurality of rivets interconnecting the stiffener, shell and straplike means.

4. A luggage case construction, comprising:

an open-sided shell of relatively soft flexible material having back, top, bottom and end walls;

a soft flexible cover removably secured over the shell open side;

an elongated extruded plastic frame of a width at least several times its thickness affixed to the shell inner wall surfaces at several spaced points and extending along the top, bottom and end walls in conforming relation therewith; and a plurality of individual sheetlike members slidingly received between said frame and the shell wall lying immediately opposite at least at points of juncture of adjacent walls for establishing shell wall dimensionality transversely of the frame long dimension;

said stiffener having such flexibility and memory characteristics that it can withstand oppositely directed torsional forces applied generally in the plane of the end walls sufficient to bring the top wall substantially into contact with the lower wall and on removal of said torsional forces, the stiffener will reassume its predetermined configuration.

5. A luggage construction as in claim 4, in which there is further provided straplike means arranged about the shell exterior surfaces of the top, side and bottom walls and lying directly opposite to the frame;

and a plurality of rivets interconnecting the frame, shell and straplike means.

6. A luggage case construction, comprising:

an open-sided sheet having back, top, bottom and end walls;

a cover received over the shell open side; and an elongated reinforcing frame of predetermined configuration contiguously extending along the inner top, bottom and end walls, said frame including a pair of continuous parallel raised portions separated by a recess extending its full length, said frame having such flexibility and memory characteristics that it can withstand either deforming forces applied to the top wall or torsional forces oppositely applied in the general plane of the end walls sufficient to bring the top wall into substantial contact with the bottom wall and reassuming said predetermined configuration on removal of said forces.

7. A luggage case as in claim 6, in which said reinforcing frame is constructed of extruded polyvinylchloride.

* * * * *

Disclaimer 3,977,501.—*Juan Perez Alonzo*, Naucalpan de Juarez, Mexico. LUGGAGE CASE CONSTRUCTION. Patent dated Aug. 31, 1976. Disclaimer filed Jul. 17, 1989, by the assignee, Samsonite Corp.

Hereby enters this disclaimer to claim 1 of said patent.

[ *Official Gazette May 29, 1990* ]